US005156658A

United States Patent [19]

Riehl

[11] Patent Number: 5,156,658

[45] Date of Patent: Oct. 20, 1992

[54] ELECTROSTATIC PRECIPITATOR GAS INLET PLENUM HAVING A CORRUGATED PERFORATED PLATE

[75] Inventor: Richard T. Riehl, Milford, N.J.

[73] Assignee: Research-Cottrell, Inc., Somerville, N.J.

[21] Appl. No.: 676,317

[22] Filed: May 1, 1991

[51] Int. Cl.[5] ..... B03C 3/36

[52] U.S. Cl. ..... 55/128; 55/112; 55/129; 55/300; 55/418

[58] Field of Search ..... 55/128, 129, 418, 419, 55/300, 112; 138/37, 39, 40, 41

[56] References Cited

U.S. PATENT DOCUMENTS

| | | | |
|---|---|---|---|
| 3,733,785 | 5/1973 | Gallaer | 55/129 |
| 3,831,350 | 8/1974 | Gilles et al. | 55/128 |
| 3,990,871 | 11/1976 | Cooper | 55/129 |
| 4,026,683 | 5/1977 | Snader et al. | 55/129 X |
| 4,213,766 | 7/1980 | Wyatt | 55/2 |
| 4,544,383 | 10/1985 | Haselmaker | 55/418 X |
| 4,695,297 | 9/1987 | Hein | 55/128 X |
| 4,883,509 | 11/1989 | Giusti et al. | 55/326 |
| 4,883,510 | 11/1989 | Giusti et al. | 55/326 |

*Primary Examiner*—Richard L. Chiesa
*Attorney, Agent, or Firm*—Howrey & Simon

[57] ABSTRACT

A gas flow distribution system for directing the flow of gas across the inlet portion of and into an electrostatic precipitator. The gas distribution system including a corrugated perforated plate for shifting and spreading gas across the inlet portion of an electrostatic precipitator.

14 Claims, 5 Drawing Sheets

ELECTROSTATIC PRECIPITATOR GAS INLET PLENUM HAVING A CORRUGATED PERFORATED PLATE

FIELD OF THE INVENTION

The present invention relates to an electrostatic precipitator gas inlet plenum having a corrugated perforated plate for providing enhanced gas flow, particularly, for turning the path line of incoming gas in the direction of the electrostatic precipitator and for uniformly spreading the gas across the electrostatic precipitator gas inlet.

BACKGROUND OF THE INVENTION

Gas flow uniformity is a factor in electrostatic precipitator performance. Gas distribution systems control the gas flow uniformity to the electrostatic precipitator. Any dust which accumulates on the gas distribution system blocks gas access through the electrostatic precipitator and as a result retards gas flow. To maximize electrostatic precipitator performance then, it is desirable to minimize dust accumulation on a gas distribution system.

A gas distribution system includes a plenum through which flue gas is distributed to the electrostatic precipitator. The quantity of dust accumulation or particulate buildup on the gas distribution system is a function of the plenum construction, as well as the type of flue gas. That is, the plenum, in channeling flue gas to the electrostatic precipitator, typically gathers dust and consequently obstructs gas flow. The amount of dust is related to the configuration and position of the plenum.

While it is common practice, after a number of machine operation cycles, to attempt to clean the plenum of dust accumulation doing such entails machine downtime. Further, in some instances the particulates must be manually removed hence, a loss in overall process efficiency. Moreover, often times cleaning is ineffective in that dust resists removal and continues to inhibit gas flow.

Typically, gas distribution systems for electrostatic precipitators include a plenum which transmits particulate laden flue gas from a duct to an electrostatic precipitator. The duct is essentially vertically positioned and has a relatively narrow interior cross sectional area. Flue gas comes in through the narrow duct and is transferred to the electrostatic precipitator. The electrostatic precipitator is positioned in an essentially horizontal direction having its opening or gas inlet approximately perpendicular to the duct. The gas inlet presents a rather large opening, relative to the duct's cross sectional area, for receipt of incoming flue gas. The incoming flue gas must be made to shift its path flow direction toward the gas inlet.

Moreover, for uniform distribution to the electrostatic precipitator the gas must be dispersed evenly over the gas inlet area.

Accordingly, a plenum is typically employed which functions to redirect and distribute the flow of gas from the flue duct to the electrostatic precipitator. It is the plenum on which dust collects, blocking the flow of gas into the electrostatic precipitator. The plenum therefore, impacts the flow of gas as it enters the electrostatic precipitator.

Commonly, as discussed subsequently in detail with reference to FIG. 1, two distinct elements are positioned in the plenum for controlling the gas flow. First, to direct the flue gas path line toward the electrostatic precipitator and avoid flue gas packing in the vertically lower-most corner of the plenum, it has been the conventional practice to place gas vanes in the interior of the plenum. Second, to distribute the gas, once redirected, across the electrostatic precipitator inlet, it has been the conventional practice to vertically extend across the plenum a flat perforated plate at the inlet location.

FIG. 1 shows a cross sectional view of a conventional electrostatic precipitator having gas distribution system 8. Here gas is input in the general direction of Arrow A through duct 10 into plenum 12 for distribution to electrostatic precipitator 14. The electrostatic precipitator then places a negative charge on gas particulates which in turn are attracted to positively charged collection plates 16. Thereafter, clean gas is expelled in the general direction of Arrow B.

As is seen in FIG. 1, it has been the common practice to utilize a ladder vane assembly 18. The ladder vane is formed by a series of near horizontal vanes and is positioned at an angle, relative to the electrostatic precipitator, across the width of plenum 12. The ladder vane shifts the initial gas path line from the general direction of Arrow A towards the horizontally positioned electrostatic precipitator 14 or the general direction of Arrow B. The ladder vane 18 includes spaced rungs **18*a* which extend between supports 18*b*. Spaced rungs 18*a* form a gap 18*c* through which the flue gas travels. More particularly, incoming flue gas following the gas path depicted by Arrow A, upon contacting the plenum sidewall 12*a* is turned towards the direction of ladder vane 18 and thereafter, upon encountering rungs 18*a*, rebounds through gap 18*c*** towards the electrostatic precipitator gas inlet.

Moreover, if only the ladder vane 18 was employed in the plenum, the gas would accumulate or pack in the lower-most corner C of plenum 12 as a result of the directional angle it assumes after entry through the ladder vane. This would obstruct uniform gas flow thereby inhibiting electrostatic precipitator performance. Thus, to spread the gas across the electrostatic precipitator gas inlet **14*c* it has been the practice to position a perforated plate 20 across plenum 12** at the electrostatic precipitator gas inlet location. The plate being perforated presents both gas obstruction areas and open regions for gas travel. The gas upon encountering both obstruction areas and open regions naturally gravitates toward the open regions thus effecting a spreading of gas across the perforated plate expanse.

Unfortunately, the conventional plenum construction has proven unsatisfactory in operation for a number of reasons. The commonly used two part system is costly in that it requires the installation of two separate elements in the plenum, the ladder vane assembly and the perforated plate. Further, in the conventional ladder vane construction frequently salt cake particulate buildup occurs. This build up impedes gas flow and is difficult to remove.

The present invention provides a one piece gas distribution structure namely, a corrugated, perforated plate provided in the plenum. The corrugated, perforated plate performs the same functions of the conventional two part ladder vane and perforated plated assembly, that is, gas turning and spreading in an improved manner.

The corrugated, perforated plate construction of the present invention limits dust accumulation for at least three reasons. In the present invention the ladder vane is eliminated, thus, dust accumulation thereon is avoided. In contrast to the conventional system the plate of the present invention is able to maintain good reliable gas flow quality across the gas inlet region, accordingly little dust actually gathers on the corrugated, perforated plate. When particulates do buildup on the corrugated perforated plate, the present invention provides a simple and efficient rapping mechanism for the ready removal of dust.

That is, while the conventional distribution structure requires the manual cleaning of the ladder vane assembly, the corrugated, perforated plate of the present invention can be readily cleaned. In the present invention, the corrugated, perforated plate is hung on pipes suspended from the plenum, which when vigorously rapped, vibrate and force dust accumulation into the electrostatic precipitator hoppers.

For the above reasons relatively stable flow quality can be maintained over a number of machine operations. Indeed, tests have demonstrated that the present invention in operation produces a good reliable flow quality. Indeed, the corrugated, perforated plate exhibits a 19.62% RMS velocity index which remains relatively constant, in contrast to the conventional system, during machine operations despite repeated cleanings.

The advantages of the present invention are set forth in part in the following description, and will be obvious from the description or may be learned by practice of the invention. The advantages of the present invention may be realized and attained by means of the instrumentalities and combinations pointed out in the appended claims.

SUMMARY OF THE INVENTION

An object of the present invention is to overcome the problems and disadvantages of the conventional electrostatic precipitator gas distribution system.

Another object is to provide a gas distribution system having good reliable gas flow quality.

To achieve the objects and in accordance with the purpose of the present invention, as embodied and broadly described herein, the present invention comprises a gas distribution system for directing the flow of gas across the gas inlet portion of and into a particulate control device ("PCD"). The gas distribution system includes a perforated plate for both shifting and uniformly dispersing gas flowing through said plate and into the gas inlet portion of a PCD.

Such plate includes a first perforated face disposed generally perpendicular to the flow of gas immediately upstream of the plate. This face has a first porosity, a distal edge distal from the inlet of the PCD, and a proximal edge proximate to the inlet of the PCD. The plate also includes a second perforated face disposed generally parallel to the flow of gas immediately upstream of the plate and at an angle relative to the first face of less than 180 degrees. This second face has a second porosity which is greater than the first porosity, a distal edge distal from the inlet of the PCD, and a proximal edge proximate to the inlet of the PCD. The proximal edge of the second face is connected to the proximal edge of the first face.

The plate is suspended within the gas distribution system and across the gas inlet portion of a PCD by means of a pipe. This pipe is constructed to withstand and transmit to the plate vibrations applied to the pipe sufficient to dislodge from the plate salt cake particulate buildup.

BRIEF DESCRIPTION OF THE DRAWINGS

The accompanying drawings, which are incorporated in and constitute a part of this specification, illustrate several embodiments of the present invention and together with the description, serve to explain the principles of the present invention.

DESCRIPTION OF THE PREFERRED EMBODIMENT

The present invention is directed to a gas distribution system for directing the flow of gas across the inlet of an electrostatic precipitator having a gas turning means for altering the initial directional flow of gas into the gas distribution system and a gas spreading means for uniformly dispersing the gas flow into the electrostatic precipitator.

Figure 1:
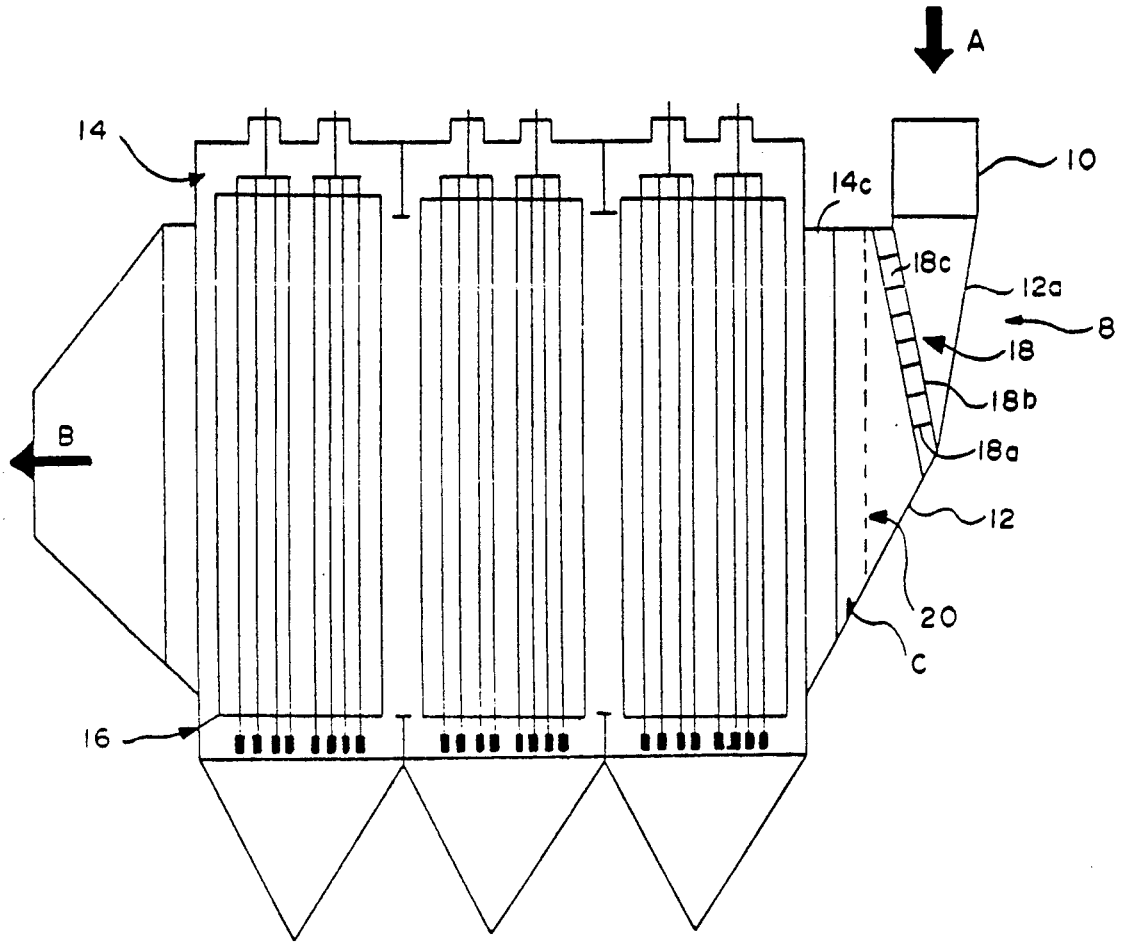
FIG. 1 PRIOR ART
FIG. 1 is a cross sectional view of a conventional electrostatic precipitator gas inlet plenum.
Figure 2:
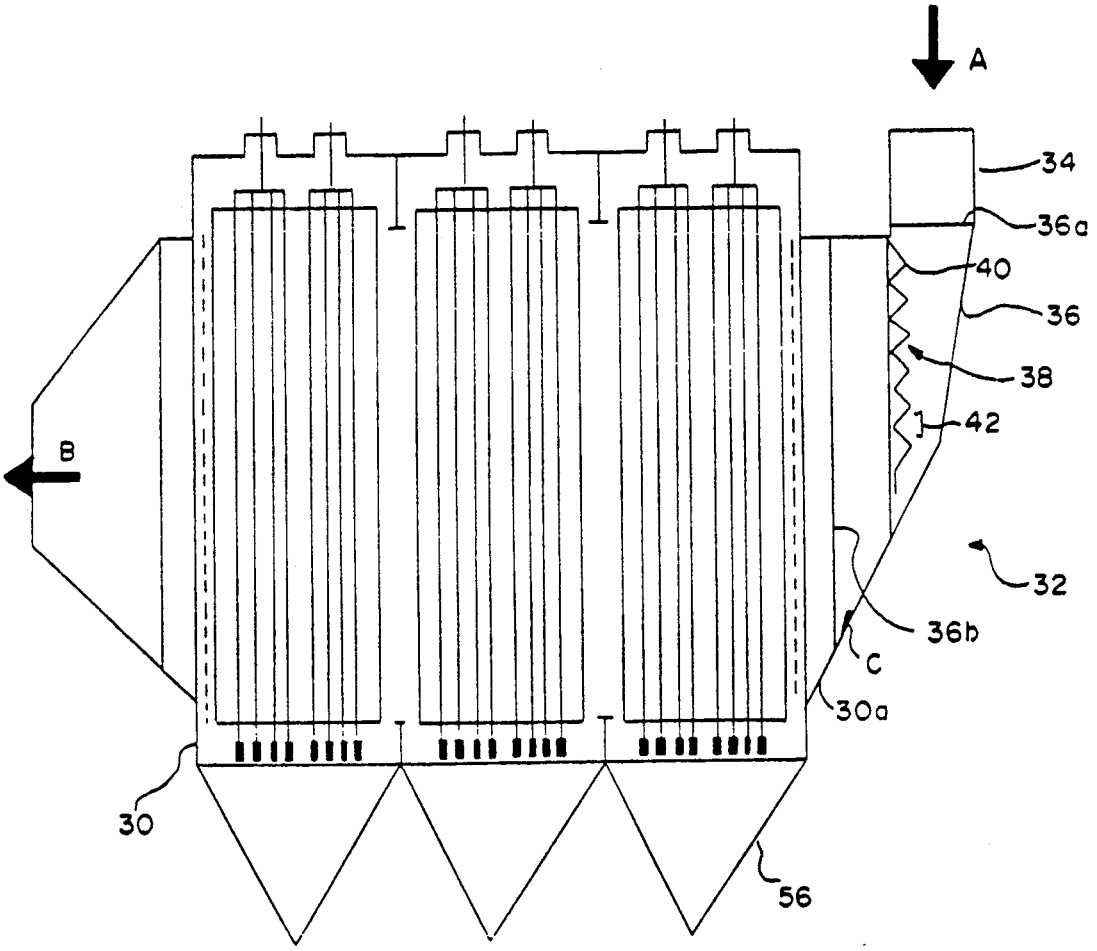
FIG. 2 is a cross sectional view of the electrostatic precipitator gas inlet plenum of the present invention.

In accordance with the invention as shown in FIG. 2, a gas distribution system 32 for electrostatic precipitator 30 is provided. The gas distribution system 2 includes a flue duct 34 through which gas flows in the general direction of Arrow A. In accordance with the invention, a plenum 36 is provided in fluid contact with both flue duct 34 and electrostatic precipitator 30. As seen in FIG. 2, plenum 36 includes a first opening **36*a* and a second opening 36*b* for the ingress and egress of flue gas, respectively. First opening 36*a* being in direct fluid contact with flue duct 34 receives gas from the general direction of Arrow A. Second opening 36*b* is in direct fluid contact with the inlet portion 30*a* of electrostatic percipitator 30** and provides the opening through which flue gas travels into the electrostatic precipitator.

In accordance with the invention, a corrugated, perforated plate 38 is positioned across the second opening **36*b*. Corrugated perforated plate 38, functions to turn the initially, vertically, oriented incoming gas towards electrostatic precipitator inlet 30*a* or in the general direction of Arrow B. Moreover, corrugated perforated plate 38 spreads the incoming gas flow uniformly across the electrostatic precipitator gas inlet 30*a* and thus prevents gas accumulation or packing in area C of plenum 36**.

In accordance with the invention as shown in FIGS. 2–7, corrugated perforated plate 38 comprises peak portions 40 and valley portions 42. As seen best in FIG. 3, valley portions 42 include a first face **42*a* and a second face 42*b*** in angular contact with one another. In operation, incoming flue gas initially contacts first face 42*a*. Thereafter, the corrugation configuration functions as a partial obstructing face, for shifting the gas towards the second face 42*b*. Consequently, gas is turned in the general direction of Arrow B into the electrostatic precipitator.

Figure 3:
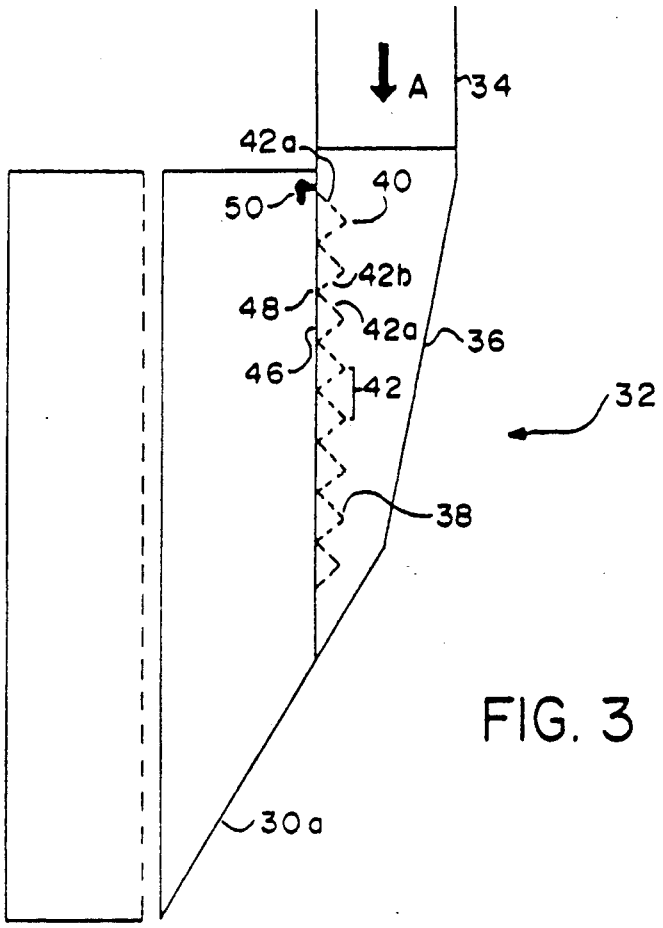
FIG. 3 is a cross sectional view of the electrostatic precipitator gas inlet of the present invention.
Figure 5:
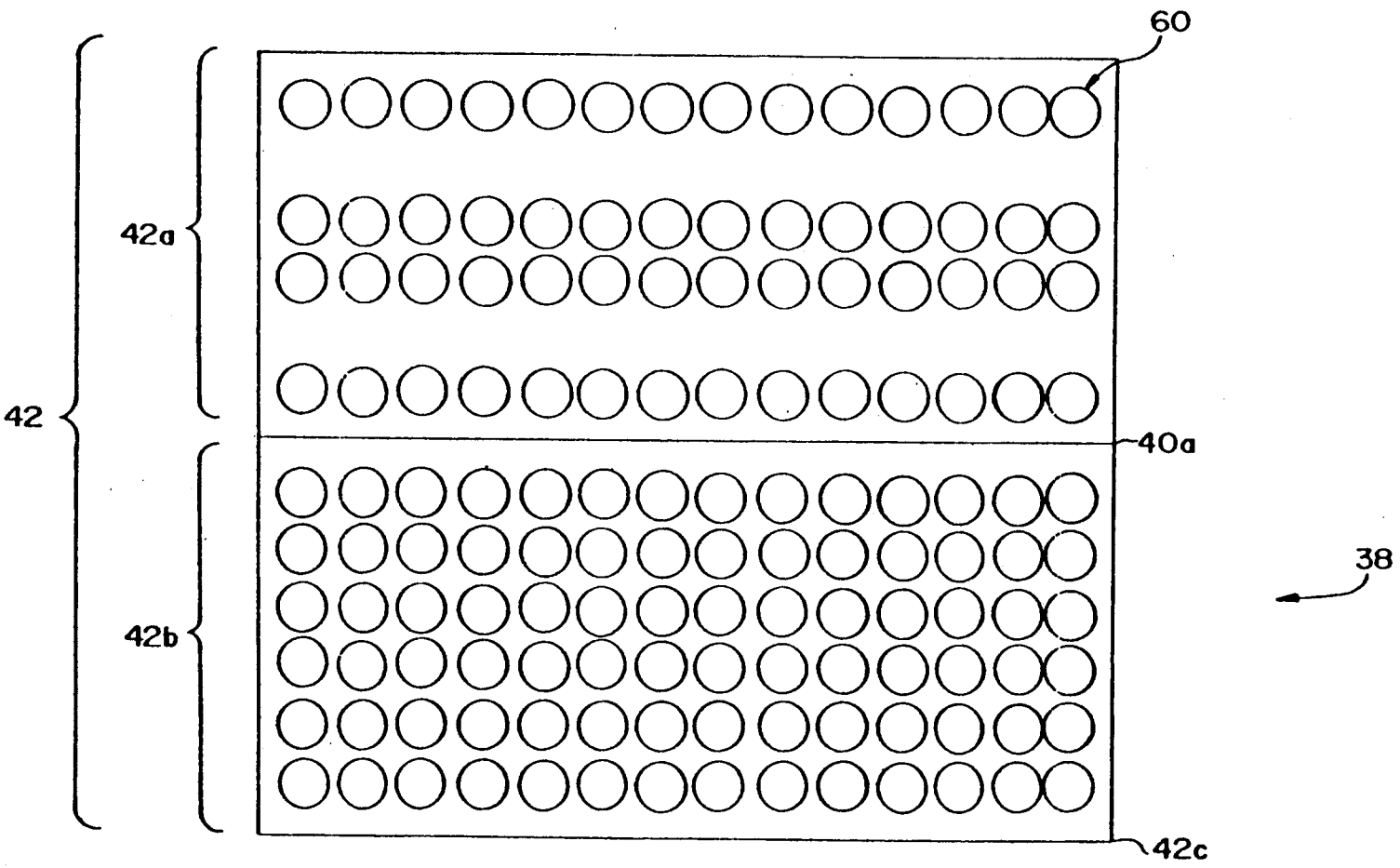
FIG. 5 is a plan view of the corrugated perforated plate showing the perforation repeat pattern for the length of the plate of the present invention.
Figure 6:
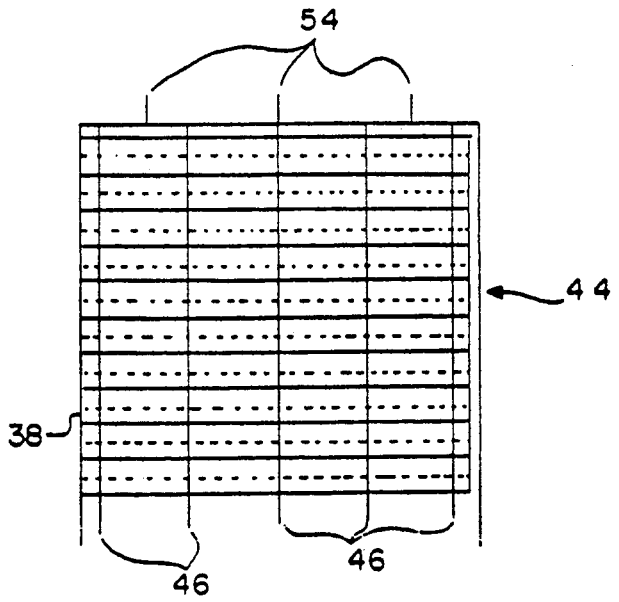
FIG. 6 is a plan view of the corrugated perforated plate showing the positioning of the pipe and rapper assembly of the present invention.

Preferably, a 90° angle is maintained between first and second faces 42*a* and 42*b*. Further, the invention contemplates that the corrugated, perforated plate be formed of twelve gauge milled steel. It is contemplated, as seen in FIGS. 3 and 5, eight repeat patterns of first and second faces 42*a* and 42*b* forming peak 40*a* and valley 42*c* bendlines, are present. The invention contemplates that each repeat pattern be approximately 36"×34" with peak bendline 40*a* and valley bendline 42*c* being approximately seventeen inches from one another.

In accordance with the invention gas turning is achieved by providing a corrugated, perforated plate having opposing faces with alternate, variable porosities. FIG. 5 depicts the preferable perforation porosities of the present invention wherein first face 42*a* has a lesser percentage open area than second face 42*b*. In this way, a partial bluff is established whereby gas contacting first face 42*a* and experiencing a larger percentage of closed surface area, relative to second face 42*b*, will naturally gravitate towards second face 42*b* having a relatively larger percentage of open space.

The present invention contemplates that first and second faces 42*a* and 42*b* have a percentage open area of approximately of 33.3% and 50%, respectively, as measured by the ratio of the total open area over the total surface area of the particular corrugated, perforated plate face.

In accordance with the invention gas spreading means is provided. The variable porosities described above operate further to spread gas over the gas inlet region. FIG. 5 shows the alternate variable porosity repeat pattern for the first and second faces of the corrugated perforated plate. Preferably, two-inch diameter perforation holes 60 are formed on both first and second faces 42*a* and 42*b* of the corrugated perforated plate. First face 42*a* may include four rows of two-inch diameter holes and the second face 42*b* may include six rows of two-inch diameter holes. As shown in FIG. 5, a 2.25" open area may be placed on either side of peak bendline 40*a* and valley bendline 42*c*. The invention contemplates that a 5.00" gap is placed on the first face 42*a* between the first and second rows of perforations and the third and fourth rows of perforations. A gap of 2.50" may be placed between the second and third rows of perforations on the second face 42*b* between the six rows of perforations.

Figure 4:
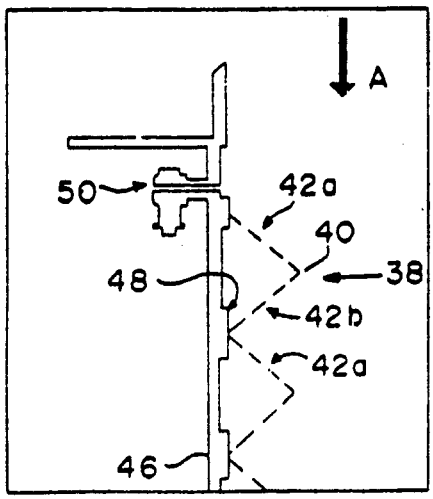
FIG. 4 is a enlarged cross sectional view of the corrugated perforated plate and pipe arrangement of the present invention.
Figure 7:
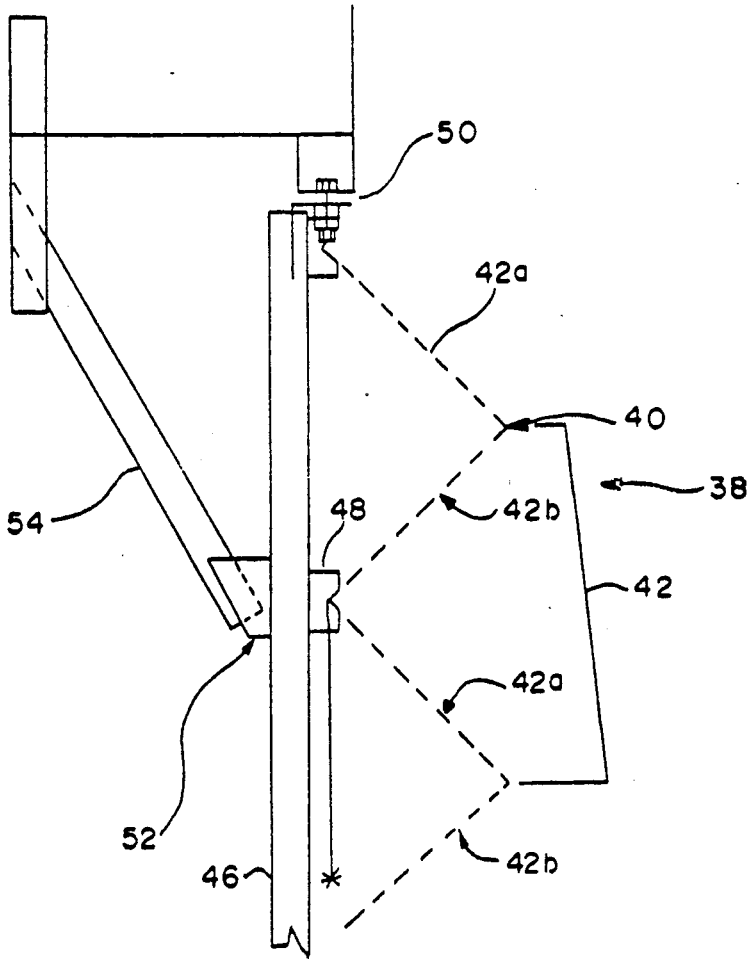
FIG. 7 is a cross sectional view of the spring hanger and rapper arrangement of the present invention.

In accordance with the present invention as seen in FIGS. 2–7, the corrugated perforated plate is secured across inlet 30*a* by means of a pipe assembly 44. As shown in FIG. 7, pipes 46 may be welded to support clips 48 which are then connected to corrugated perforated plate 38. Corrugated perforated plate 38 may be attached by a spring hanger arrangement 50 to plenum 36 (FIGS. 4 and 7). As shown in FIG. 7, an anvil bar 52 may laterally extend across pipes 46. A rapper anvil 54 may be used to vigorously rap anvil bar 52. The rapper anvil is used repeatedly to contact or beat pipes 46. In this way vibration energy is transmitted to pipes 46. As a result, existing salt cake particulate buildup can be knocked off the corrugated perforated plate and dispelled through perforated holes 60 into a hopper 56 (shown in FIG. 2) located beneath electrostatic precipitator 30.

Other embodiments of the present invention will be apparent to those skilled in the art from consideration of the specification and practice of the disclosed invention. It is intended that the specification and examples be considered as exemplary only, with the true scope and spirit of the invention being represented by the following claims.

What is claimed is:

1. A perforated plate for shifting and uniformly dispersing gas flowing through said plate and into the inlet of a particulate control device ("PCD"), said plate comprising:
   (a) a first perforated face being disposed generally perpendicular to the flow of gas immediately upstream of said plate, said first face having a first porosity, a distal edge distal from the inlet of the PCD, and a proximal edge proximate to the inlet of the PCD; and
   (b) a second perforated face being disposed generally parallel to the flow of gas immediately upstream of said plate and at an angle relative to said first face of less than 180 degrees, said second face having a second porosity which is greater than said first porosity, a distal edge distal from the inlet of the PCD, and a proximal edge proximate to the inlet of the PCD, said proximal edge of said second face being connected to said proximal edge of said first face.

2. The perforated plate of claim 1 wherein said first porosity is approximately 33.3%, and said second porosity is approximately 50%.

3. The perforated plate of claim 1 wherein said angle between said first face and said second face is approximately 90 degrees.

4. A corrugated, perforated plate for shifting and uniformly dispersing gas flowing through said plate and into the inlet of a particulate control device ("PCD"), said plate comprising:
   (a) a first longitudinal edge;
   (b) a second longitudinal edge; and
   (c) a plurality of longitudinally disposed valleys extending from said first longitudinal edge to said second longitudinal edge, each valley including:
      (i) a first perforated face being disposed generally perpendicular to the flow of gas immediately upstream of said plate, said first face having a first porosity, a distal edge distal from the inlet of the PCD, and a proximal edge proximate to the inlet of the PCD and parallel to said distal edge of said first face; and
      (ii) a second perforated face being disposed generally parallel to the flow of gas immediately upstream of said plate and at an angle relative to said first face of less than 180 degrees, said second face having a second porosity which is greater than said first porosity, a distal edge distal from the inlet of the PCD, and a proximal edge proximate to the inlet of the PCD, said proximal edge of said second face being parallel to said distal edge of said second face and being connected to said proximal edge of said first face.

5. The corrugated, perforated plate of claim 4 wherein said first porosity is approximately 33.3%, and said second porosity is approximately 50%.

6. The corrugated, perforated plate of claim 4 wherein said angle between said first face and said second face is approximately 90 degrees.

7. A gas distribution system for supplying gas uniformly and generally perpendicular to the inlet of a particulate control device ("PCD"), said system comprising:

(a) a plenum including:

(i) a plenum inlet for receiving gas; and (ii) a plenum outlet generally perpendicular to said plenum inlet, said plenum outlet being in communication with the PCD inlet to discharge gas from the plenum to the PCD; and (b) a perforated plate disposed across, and generally parallel to said plenum outlet for shifting and uniformly dispersing gas flowing through said plate and into the inlet of the PCD, said plate comprising:

(i) a first perforated face being disposed generally perpendicular to the flow of gas immediately upstream of said plate, said first face having a first porosity, a distal edge distal from the inlet of the PCD, and a proximal edge proximate to the inlet of the PCD; and (ii) a second perforated face being disposed generally parallel to the flow of gas immediately upstream of said plate and at an angle relative to said first face of less than 180 degrees, said second face having a second porosity which is greater than said first porosity, a distal edge distal from the inlet of the PCD, and a proximal edge proximate to the inlet of the PCD, said proximal edge of said second face being connected to said proximal edge of said first face.

8. The gas distribution system of claim 7 wherein said first porosity is approximately 33.3%, and said second porosity is approximately 50%.

9. The gas distribution system of claim 7 wherein said angle between said first face and said second face is approximately 90 degrees.

10. The gas distribution system of claim 7 further comprising a pipe, said pipe being mounted on said plenum and being connected to said plate to suspend said plate within said plenum, said pipe being constructed to withstand and transmit to said plate vibrations applied to said pipe sufficient to dislodge from said plate salt cake particulate buildup.

11. The gas distribution system of claim 10 further comprising an anvil bar, said anvil bar being connected to said pipe and being constructed to withstand and transmit to said pipe vibrations directly applied to said anvil bar.

12. The gas distribution system of claim 11 further comprising a rapper anvil, said rapper anvil being movably attached to said plenum proximate to said anvil bar for selectively striking said anvil bar to produce vibrations.

13. The gas distribution system of claim 10 further comprising means for resiliently mounting said pipe to said plenum.

14. The gas distribution system of claim 13 wherein said mounting means comprises a spring hanger.

* * * * *